United States Patent [19]

Funke

[11] 4,014,559

[45] Mar. 29, 1977

[54] SKI POLE ASSEMBLY

[75] Inventor: Peter Funke, Munich, Germany

[73] Assignee: ISPOW AG, Chur, Switzerland

[22] Filed: Feb. 17, 1976

[21] Appl. No.: 658,834

[30] Foreign Application Priority Data

Feb. 20, 1975 Germany ..... 2507352

[52] U.S. Cl. ..... 280/11.37 N

[51] Int. Cl.[2] ..... A63C 11/24

[58] Field of Search ..... 280/11.37 N, 11.37 Z, 280/11.37 P, 11.37 H, 11.37 B, 11.37 L, 11.37 F; 135/81, 80, 70, 77

[56] References Cited

UNITED STATES PATENTS

| | | | |
|---|---|---|---|
| 404,303 | 5/1889 | Remillard | 135/81 |
| 3,637,229 | 1/1972 | Klemm | 280/11.37 P |
| 3,645,553 | 2/1972 | Hinterholzer | 280/11.37 Z |
| 3,858,900 | 1/1975 | Quinn | 280/11.37 N |

FOREIGN PATENTS OR APPLICATIONS

| | | | |
|---|---|---|---|
| 400,539 | 8/1924 | Germany | 280/11.37 N |
| 7,321,869 | 10/1973 | Germany | 280/11.37 P |
| 60,113 | 11/1938 | Norway | 280/11.37 Z |
| 439,048 | 12/1967 | Switzerland | 280/11.37 Z |
| 161,080 | 6/1933 | Switzerland | 280/11.37 N |
| 50,086 | 2/1910 | Switzerland | 280/11.37 N |

OTHER PUBLICATIONS

"Eurosport and Freizeitmode" Apr., 1973, p. 745.

*Primary Examiner*—Robert R. Song
*Assistant Examiner*—David M. Mitchell
*Attorney, Agent, or Firm*—Hans Berman

[57] ABSTRACT

A ski pole assembly in which a snow engaging disc or like member near one axial end of the ski pole is biased toward a rest position by a resilient tubular mounting member, approximately coaxial with the pole and having respective axial parts fastened to the main portion of the pole and the snow engaging member respectively. The snow engaging member covers the free end of the pole in its rest position only.

15 Claims, 5 Drawing Figures

SKI POLE ASSEMBLY

This invention relates to ski poles, and particularly to a ski pole assembly in which the free end of the pole member is automatically covered to prevent it from injuring people when not in use.

Known ski pole assemblies with automatically protected pole ends rely on relatively heavy devices which themselves are not always free from sharp corners or edges that may cause injury. It is a primary object of this invention to provide a ski pole assembly in which accidents caused by the free operating end of the idle ski pole are safely avoided by an arrangement which does not materially add to the weight of the pole assembly and is itself free from potentially dangerous sharp points, edges, or corners.

With this object and others in view, as will presently become apparent, the ski pole assembly of the invention includes a snow engaging member having a snow engaging face and formed with an aperture therethrough, and a yieldably resilient, tubular mounting device which receives a part of the pole therein and secures the snow engaging member to the pole for axial movement relative to the pole between an operative position and a rest position. The main portion of the pole and its free end portion project from the aperture in the snow engaging member in opposite axial directions when the snow engaging member is in its operative position, and the snow engaging member is offset from the operative position axially away from the main portion of the pole when in the rest position. The mounting device biases the snow engaging member toward the rest position.

Other features, additional objects, and many of the attendant advantages of this invention will readily be appreciated as the same becomes better understood from the following detailed description of preferred embodiments when considered in connection with the appended drawing in which.

Figure 1:
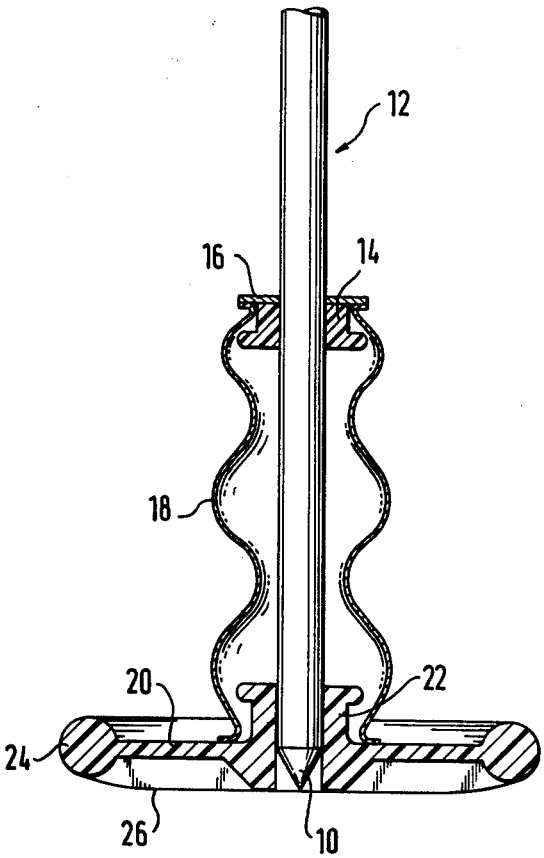
FIG. 1 shows a ski pole assembly of the invention in fragmentary elevational section on the pole axis.

Referring initially to FIG. 1, there is shown the free lower end including a conical point 10 and the lower part of the tubular main portion 12 of an aluminum ski pole. The upper part of the generally cylindrical main portion 12 has been omitted from FIG. 1 since it may be entirely conventional, a loop or strap of leather or like material being attached to the nonillustrated upper end of the pole.

A plastic collar 14 and a metal washer 16 are fixedly fastened to the outer face of the main pole portion 12. The washer provides an abutment for tubular aluminum bellows 18, coaxial with the pole portion 12, and the collar prevents movement of the bellows away from the washer. The other, annular end of the bellows 18 abuts against an annular disc 20 whose hub 22 slidably receives the lower end of the pole. A collar on the hub 22 prevents release of the disc 20 from the bellows 18. The disc 20 has an integral, toroidal rim 24 and radial ribs 26 connecting the rim 24 to the hub 22 for adequate strength.

In the illustrated rest position of the disc 20, the bellows 18 is in the relaxed condition. When the pole assembly is placed on a snow surface, and the skier's weight is partly transmitted to the pole, the lower radial face of the disc 20 engages the snow and impedes sinking of the disc in the snow while the bellows 18 is axially compressed and the point 10 is pushed outward of the central aperture of the disc 20 to penetrate the snow. When the pole is lifted from the snow, the axially expanding bellows 18 causes the disc 20 to revert to the illustrated rest position in which the point 10 is retracted inward of the orifice in the bottom face of the disc 20. Full protection from injury by the point 10 is afforded, for example, while the pole assembly is being carried to or from a slope on the skier's shoulders.

The weight of the ski pole assembly shown in FIG. 1 differs from that of an otherwise conventional assembly with fixed snow engaging disc only by the added weight of the bellows 18 which is negligible compared to that of the other assembly components. The exposed, imperforate, outer face of the flexible, smoothly contoured bellows cannot itself cause injury, its edges being covered by the washer 16 and the disc 20. The washer 16 is attached to the pole portion 12 by a spot weld, not shown, but all other elements shown in FIG. 1 are assembled without tools by snap fits.

Materials of construction other than those described with reference to FIG. 1 may be employed in the ski pole assembly of the invention, and their nature may call for structural modifications of the type illustrated in the other Figures of the drawing.

Figure 2A:
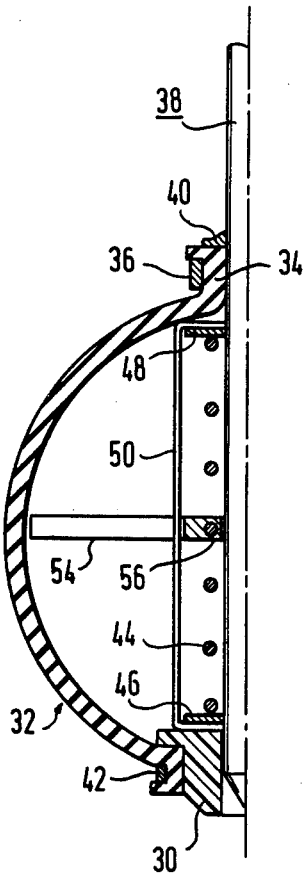
FIG. 2A shows another embodiment of the invention in corresponding, fragmentary, elevational section with its snow engaging member in the rest position.

The ski pole assembly shown in FIG. 2A in the rest position of its snow engaging member and in FIG. 2B in the oerative position includes a pole 38 which is identical with the lightmetal pole described with reference to FIG. 1. Its pointed free end is retracted in FIG. 2A into the bore of a plastic bushing 30 whose upper end carries a radial flange whereas the lower end tapers conically downward. The bushing 30 is received in one of two diametrically opposite openings of a rubber ball 32 whose rims carry integral reinforcing rings 34. The lower reinforcing ring of the ball 32 is fastened to the bushing 30 by a metal clamp 42.

The upper reinforcing ring 34 is held in tight engagement with the main portion of the pole 38 by a metallic clamping ring 36, and its axial movement relative to the pole is further prevented by axially abutting engagement with a fixed metallic collar 40 on the pole 38. The elastomeric ball 32 is biased toward the rest position shown in FIG. 2A by a helical compression spring 44 coaxially enveloping the pole 38 in the cavity of the ball 32, and axial expansion of the ball beyond the position of FIG. 2A under the pressure of the spring 44 is prevented by a flexible strap 50 one end of which is clamped between a washer 46 movably mounted on the pole 38 and the bushing 30, while the other end is clamped between a corresponding washer 48 and the upper reinforcing ring 34, the clamping pressure being provided by the spring 44 which is seated on the washers 46, 48.

Radial collapse of the ball 32 is prevented by an approximately star-shaped, annular disc 54 which slidably receives the pole 38 in its central apertures. The strap 50 passes through one of the several notches which extend radially inward from the outer circumference of the disc 54. The central part of the disc 54 is fastened to a turn 56 of the spring 44 which is axially equidistant from the washers 46, 48.

Figure 2B:
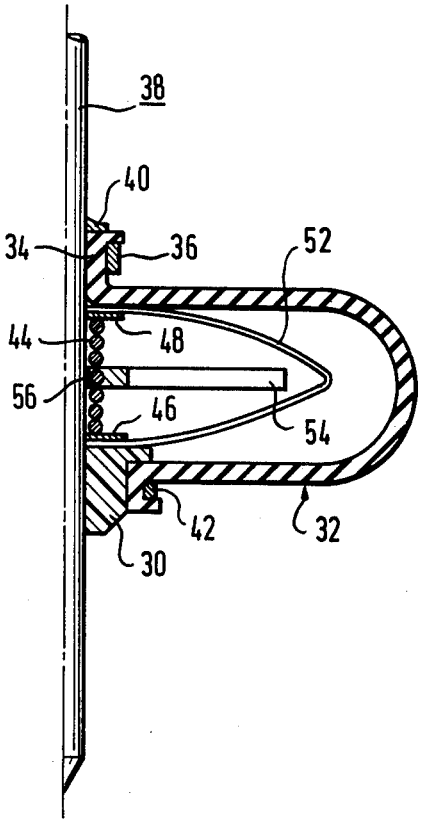
FIG. 2B illustrates the device of FIG. 2A in the operative position of its snow engaging member.

FIG. 2B shows the same ski pole assembly in the shape assumed when the bushing 30 engages a snow surface and weight is applied to the pole 38. The pressure of the snow flattens the ball 32 into the shape of a body of revolution having planar, radial top and bottom faces connected by a toroidally arcuate bulge. In the limiting position shown in FIG. 2B, further axial compression of the ball 32 is prevented by abutting engagement of the several turns of the spring 44. The strap 52, identical with the strap 50, is folded outward of the notches in the disc 54. The strap may consist of glass-fiber reinforced plastic or other flexible material of high longitudinal strength.

The snow engaging, lower radial face of the ball 32 is enlarged by the pressure axially applied to the pole 38. This advantageous feature is achieved at least to some extent in the lighter and structurally simpler embodiment of the invention illustrated in FIG. 3.

Figure 3:
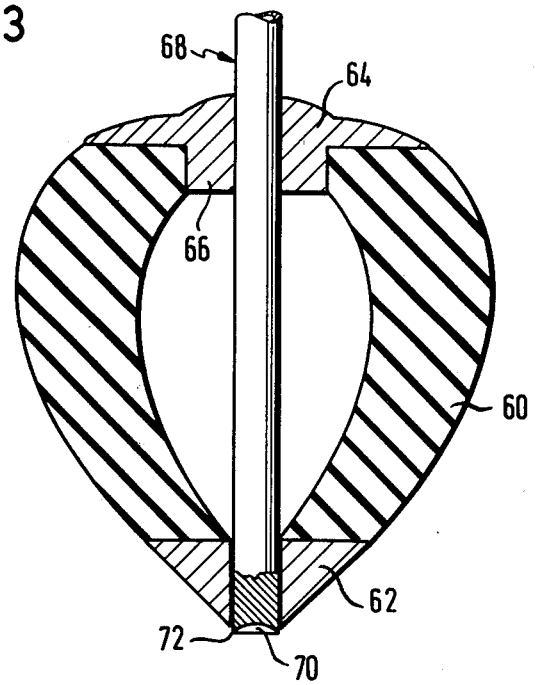
FIGS. 3 and 4 show additional aki pole assemblies of the invention in respective views analogous to FIG. 1.

The pole 68 is slidably received in a snow-engaging, light-metal bushing 62 of approximately conical shape. A flanged, coaxial plug 66 is fixedly mounted on the main portion of the pole 68, and tubular rubber body 60 having the approximate shape of a pear in the relaxed condition illustrated in FIG. 3 is vulcanized to an annular, radial face of the flange 64 on the plug 66 and to the radial base of the conical bushing 62. The wall thickness of the body 60 decreases gradually from the flange 64 to the bushing 62.

The free lower end of the otherwise tubular pole 68 is solid and has a transverse end face 70 which is approximately spherically concave. The end face merges with the uniformly cylindrical, outer, axial face of the pole 68 in a circular edge 72 which is acutely angular in cross section in a plane through the axis of the pole, as is shown in FIG. 3. The edge 72 is analogous in its snow holding properties and in its ability of causing injury to the conical point illustrated in the other figures of the drawing, and the two configurations of the free pole ends are interchangeable in all illustrated embodiments of the invention.

When the ski pole assembly shown in FIG. 3 is pressed against a snow surface, the rubber body 60 is axially compressed, thereby causing the free pole end to project downward from the aperture in the bushing 62. The compressive stress causes spreading and flattening of the thinner-walled part of the body 60 near the bushing 62 to provide an approximately radial snow engaging face. The heavy-walled upper part of the body 32 undergoes less deformation and tends to restore the illustrated rest position.

Figure 4:
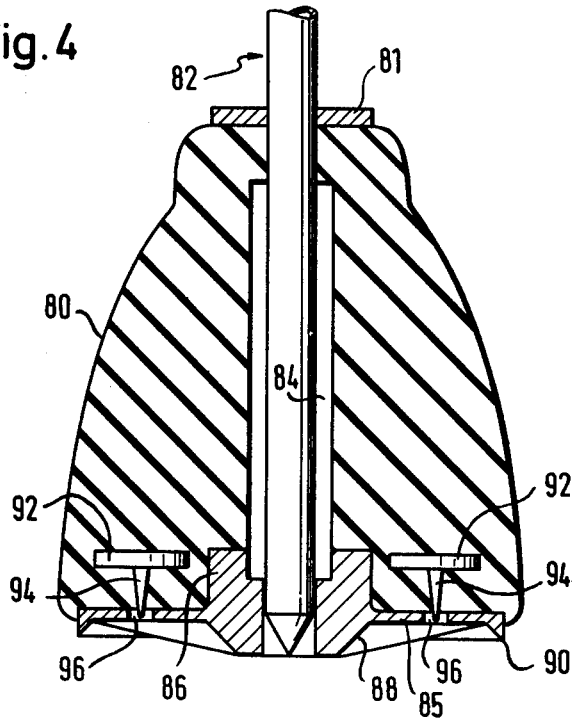

The ski pole assembly partly shown in FIG. 4 includes a pole 82 identical with the pole shown in FIG. 1 and carrying a fixed annular disc 81 on its tubular main portion. A resiliently compressible, tubular body 80 of elastomeric material coaxial with the pole 82 flares approximately conically from the disc 81 toward a larger, coaxial, circular, metal disc 85 whose central hub portion 88 slidably receives the free end portion of the pole 82 in the illustrated rest position of the disc 85. The bore 84 of the body 80 is of stepped, cylindrical shape. Only its top portion is dimensioned for firm engagement with the outer face of the pole 82, whereas adequate clearance is provided elsewhere between the pole 82 and the body 80 so that frictional engagement with the pole cannot impede axial compression of the body 80.

The disc 85 has an exposed, radial, snow engaging face about the hub portion 88, and an integral, circular rim 90 of angular cross section prevents warping of the relatively thin metal disc 85 and provides some snow holding action without presenting a significant hazard. The heads of inserts 92 are molded into the material of the body 80. The inserts have the approximate shape of oversized thumb tacks, and their stems 94 taper from the head toward openings 96 in the disc 85 in which the sharp points of the inserts 92 are retracted in the illustrated rest position of the assembly.

When the lower radial face of the disc 95 is engaged by snow under pressure, the disc 85 is moved axially toward the main portion of the pole 80, and the resulting axial compression of the tubular body 80 causes the points of the inserts 92 to project from the openings 96 so as to complement the snow holding effect of the pointed tip of the pole 82.

The hollow, resilient body 80 is preferably made of polyurethane foam whose light weight and resiliency make it particularly suitable for the purpose of this invention. The polyurethane is foamed in a mold whose cavity is partly bounded by the disc 81, the rod 82, and a removable cover carrying the inserts 92 and a core for shaping the wide portion of the bore 84. The tubular body 80 is thus integrally bonded to the disc 81, the pole 82, and the inserts 92. It may be bonded adhesively to the disc 85, but other methods of movably securing the disc 85 to the pole 82 by means of the body 80 will readily suggest themselves.

It should be understood, therefore, that the foregoing disclosure relates only to preferred embodiments of the invention, and that it is intended to cover all changes and modifications of the examples of the invention herein chosen for the purpose of the disclosure which do not constitute departures from the spirit and scope of the invention set forth in the appended claims.

What is claimed is:

1. A ski pole assembly comprising:

a. an elongated pole member having a longitudinal axis, an axial main portion, and an axial free end portion shaped for axially penetrating a snow surface;

b. a snow engaging member formed with an aperture axially extending therethrough for movably receiving a portion of said pole member, 1. said snow engaging member having a snow engaging face transverse to said axis and directed axially away from said main portion;

c. an axially compressible, resilient tubular mounting member having two axially terminal parts, 1. said terminal parts being annular about said axis and being fastened to said pole member and to said snow engaging member respectively, whereby said snow engaging member is secured to said pole member for relative axial movement between an operative position and a rest position of said snow engaging member, 2. said end portion projecting from said face in the operative position of said snow engaging member, 3. said snow engaging member in said rest position covering said free end portion, 4. said mounting member biasing said snow engaging member toward said rest position.

2. An assembly as set forth in claim 1, wherein said mounting member is a bellows member.

3. An assembly as set forth in claim 1, wherein said mounting member consists essentially of elastomeric material and has the approximate shape of a body of revolution about said axis.

4. An assembly as set forth in claim 3, wherein the wall thickness of said mounting member decreases between said parts thereof toward said snow engaging member.

5. An assembly as set forth in claim 3, wherein said mounting member flares approximately conically from said main portion toward said end portion.

6. An assembly as set forth in claim 1, said mounting member having a bore, a helical compression spring enveloping said pole member in said bore and having respective terminal portions fastened to said terminal parts of said mounting member, said spring biasing said parts axially away from each other.

7. An assembly as set forth in claim 6, a flexible, elongated tension member having respective longitudinal end portions fastened to said terminal parts in said bore and thereby limiting the expansion of said mounting member.

8. An assembly as set forth in claim 1, mounting member having a bore, a disc member projecting radially outward from said pole member in said bore for engagement with said mounting member and thereby limiting radial contraction of said mounting member.

9. An assembly as set forth in claim 1, wherein said mounting member consists essentially of cellular, elastomeric material.

10. An assembly as set forth in claim 1, wherein said mounting member has an exposed, imperforate, outer face extending from one of said terminal parts to the other terminal part.

11. An assembly as set forth in claim 1, further comprising a projection fastened to said face for movement with said snow engaging member between said positions, said projection extending outward of said face away from said main portion in said operative position of the snow engaging member and tapering in a direction away from said face.

12. An assembly as set forth in claim 11, wherein said projection is annular about said axis and spaced radially away from said aperture.

13. An assembly as set forth in claim 11, wherein said snow engaging member is formed with an opening extending axially therethrough and spaced radially from said aperture, said projection being partly embedded in said mounting member in alignment with said opening and projecting from said opening in said operative position of the snow engaging member while being withdrawn inward of said opening in the rest position of said snow engaging member.

14. An assembly as set forth in claim 1, wherein said end portion has a transverse end face of concavely arcuate cross section and an axial face of annular cross section, said faces merging in an edge, said edge being of acutely angular cross section in a plane through said axis.

15. An assembly as set forth in claim 1, wherein said aperture has an orifice in said face, said end portion being retracted inward of said orifice in said rest position of said snow engaging member.

* * * * *